US010144981B2

(12) United States Patent
Kikuchi et al.

(10) Patent No.: US 10,144,981 B2
(45) Date of Patent: Dec. 4, 2018

(54) PROCESS FOR MANUFACTURING REDUCED IRON AGGLOMERATES

(71) Applicant: Kobe Steel, Ltd., Kobe-shi (JP)

(72) Inventors: Shoichi Kikuchi, Kobe (JP); Takao Harada, Kobe (JP); Shingo Yoshida, Kobe (JP)

(73) Assignee: KOBE STEEL, LTD., Kobe-shi (JP)

( * ) Notice: Subject to any disclaimer, the term of this patent is extended or adjusted under 35 U.S.C. 154(b) by 441 days.

(21) Appl. No.: 14/377,373

(22) PCT Filed: Feb. 28, 2013

(86) PCT No.: PCT/JP2013/055507
§ 371 (c)(1),
(2) Date: Aug. 7, 2014

(87) PCT Pub. No.: WO2013/129604
PCT Pub. Date: Sep. 6, 2013

(65) Prior Publication Data

US 2015/0027275 A1 Jan. 29, 2015

(30) Foreign Application Priority Data

Feb. 28, 2012 (JP) ..... 2012-042395

(51) Int. Cl.

| | |
|---|---|
| ***C21B 11/08*** | (2006.01) |
| ***C21B 3/00*** | (2006.01) |
| ***C22B 1/245*** | (2006.01) |
| ***C21B 13/00*** | (2006.01) |
| ***C21B 13/10*** | (2006.01) |
| *B22F 9/22* | (2006.01) |

(52) U.S. Cl.
CPC ..... *C21B 11/08* (2013.01); *C21B 3/00* (2013.01); *C21B 13/0046* (2013.01); *C21B 13/105* (2013.01); *C22B 1/245* (2013.01); *B22F 9/22* (2013.01)

(58) Field of Classification Search
CPC ..... B22F 9/22; C21B 11/08; C21B 13/0046; C21B 13/105; C21B 3/00; C22B 1/245
USPC ..... 75/484, 313, 746
See application file for complete search history.

(56) References Cited

U.S. PATENT DOCUMENTS

| | | | | |
|---|---|---|---|---|
| 5,474,592 | A * | 12/1995 | Bresser | C22B 7/02 423/108 |
| 6,258,149 | B1 * | 7/2001 | Sugiyama | C21B 13/10 266/177 |
| 2004/0020326 | A1 | 2/2004 | Ibaraki et al. | |
| 2008/0250980 | A1 * | 10/2008 | Mittelstadt | C22B 1/243 106/668 |
| 2010/0294079 | A1 | 11/2010 | Ibaraki et al. | |
| 2011/0023657 | A1 * | 2/2011 | Ibaraki | C21B 13/0046 75/369 |
| 2011/0265603 | A1 * | 11/2011 | Sugiyama | C21B 13/0046 75/331 |
| 2012/0006449 | A1 * | 1/2012 | Hino | C21B 13/0006 148/103 |

FOREIGN PATENT DOCUMENTS

| | | | | |
|---|---|---|---|---|
| CN | 1473204 | A | 2/2004 | |
| JP | 2002 206120 | | 7/2002 | |
| JP | 2003 73722 | | 3/2003 | |
| JP | 2004 218019 | | 8/2004 | |
| JP | 2004 285399 | | 10/2004 | |
| JP | WO 2010084822 | A1 * | 7/2010 | C21B 13/0046 |
| JP | WO 2010117008 | A1 * | 10/2010 | C21B 13/0006 |

OTHER PUBLICATIONS

Written Opinion of the International Search Report dated Mar. 26, 2013 in PCT/JP13/055507 Filed Feb. 28, 2013.
International Search Report dated Mar. 26, 2013 in PCT/JP13/055507 Filed Feb. 28, 2013.

* cited by examiner

*Primary Examiner* — Jenny R Wu
(74) *Attorney, Agent, or Firm* — Oblon, McClelland, Maier & Neustadt, L.L.P.

(57) ABSTRACT

A process for manufacturing reduced iron agglomerates which comprises introducing starting agglomerates that comprise both an iron oxide-containing material and a carbonaceous reducing agent onto the hearth of a moving-bed heating furnace, and heating the agglomerates to reduce the iron oxide contained in the agglomerates, wherein the iron oxide-containing material contained in the starting agglomerates has a mean particle diameter of 4 to 23 μm and contains at least 18% of particles having diameters of 10 μm or less. By the use of such starting agglomerates, the process attains: an improvement in the yield of reduced iron agglomerates having large particle diameters; a reduction in the manufacturing time, said reduction leading to an enhancement in the productivity; and a remarkable reduction in the content of impurities such as sulfur in the reduced-iron agglomerates.

8 Claims, No Drawings

PROCESS FOR MANUFACTURING REDUCED IRON AGGLOMERATES

TECHNICAL FIELD

The present invention relates to a process for manufacturing reduced iron agglomerates by charging compacts composed of a raw-material mixture that contains an iron oxide-containing material and a carbonaceous reducing agent onto a hearth of a moving-bed heating furnace and heating the compacts to subject iron oxide in the compacts to reduction or reduction-melting.

BACKGROUND ART

A direct reduction ironmaking process for the manufacture of agglomerative (including granular) metallic iron (reduced iron) from a mixture containing an iron-oxide source (hereinafter, also referred to as an "iron oxide-containing material"), for example, iron ore or iron oxide, and a carbon-containing reducing agent (hereinafter, also referred to as a "carbonaceous reducing agent") has been developed. In this ironmaking process, compacts into which the mixture is formed are charged onto a hearth of a moving-bed heating furnace. The compacts are heated in the furnace by gas heat transfer and radiant heat with a heating burner to reduce iron oxide in the compacts with carbonaceous reducing agent. Subsequently, the resulting reduced iron is carburized, melted, and coalesced into agglomerates while being separated from by-product slag. Then the agglomerates are cooled and solidified to provide agglomerative metallic iron (reduced iron agglomerates).

Such an ironmaking process does not require a large-scale facility, such as a blast furnace, and has a high degree of flexibility in resources, for example, no need for coke; hence, the ironmaking process have recently been studied to achieve practical use. To perform it on an industrial scale, however, there are many problems regarding, for example, stable operation, safety, cost, the quality of granular iron (product), productivity to be solved.

In particular, in order to manufacture reduced iron agglomerates, it is desirable to improve the yield of large-grain reduced iron agglomerates and a reduction in manufacturing time. Regarding such a technique, for example, PTL 1 reports that "a method for manufacturing granular metallic iron includes heating a raw material that contains an iron oxide-containing material and a carbonaceous reductant to reduce a metal oxide in the raw material, further heating the resulting metal to melt the metal, and allowing the metal to coalesce to form a granular metal while being separated from a by-product slag component, in which a coalescence-promoting agent for the by-product slag is compounded in the raw material".

In this technique, a large-grain granular metal should be manufactured in a high yield to some extent by compounding the coalescence-promoting agent (for example, fluorite). However, also in such a technique, the improvement effect is saturated, so further improvement of the effect is desired.

Regarding the quality of the reduced iron agglomerates, the granular iron manufactured by the foregoing ironmaking method is fed to an existing steelmaking facility and used as an iron source. Thus, the granular iron desirably has a low content of impurity elements, such as sulfur. As a technique therefor, for example, PTL 2 reports that "a method for manufacturing granular metallic iron having a low sulfur content includes charging a mixture that contains a metal oxide-containing substance and a carbonaceous reductant onto a hearth of a moving-bed heating furnace, heating the mixture to reduce iron oxide in the mixture with the carbonaceous reductant, allowing the metallic iron formed to coalesce into granules while the metallic iron is separated from a by-product slag, and solidifying the granules by cooling, in which the amounts of CaO, MgO, and $SiO_2$-containing substances in the mixture are adjusted in such a manner that the basicity of slag components, i.e., $(CaO+MgO)/SiO_2$, is in the range of 1.2 to 2.3 and that the content of MgO (MgO) in the components contained in the slag is in the range of 5% to 13%, determined from the contents of CaO, MgO, and $SiO_2$ in the mixture".

In this technique, a MgO-containing substance (for example, dolomite ore) is added to the mixture to adjust the slag components, thereby providing granular metallic iron having a low sulfur content. Also in this technique, the improvement effect is saturated, so further improvement of the effect is desired.

Note that the coalescence-promoting agent, such as fluorite, and the MgO-containing substance, such as dolomite ore, are both commonly used as melting-point-adjusting agents.

CITATION LIST

Patent Literature

PTL 1: Japanese Unexamined Patent Application Publication No. 2003-73722

PTL 2: Japanese Unexamined Patent Application Publication No. 2004-285399

SUMMARY OF INVENTION

Technical Problem

The present invention has been accomplished in light of the foregoing circumstances. It is an object of the present invention to provide a process for manufacturing reduced iron agglomerates by heating compacts composed of a raw-material mixture that contains at least an iron oxide-containing material and a carbonaceous reducing agent with a moving-bed heating apparatus to subject the iron oxide in the compacts to reduction-melting, the process being such that the yield of the reduced iron agglomerates having large grain size is improved, the productivity is improved by a reduction in manufacturing time, and the content of impurity elements, such as sulfur, in the reduced iron agglomerates is minimized.

Solution to Problem

A process for manufacturing reduced iron agglomerates according to the present invention that solves the foregoing problems includes charging compacts that contain an iron oxide-containing material and a carbonaceous reducing agent onto a hearth of a moving-bed heating furnace, and heating the compacts to reduce iron oxide in the compacts, in which each of the compacts that contains the iron oxide-containing material having a mean particle diameter of 4 to 23 μm and containing particles with a particle diameter of 10 μm or less in a proportion of 18% by mass or more is used.

In the process according to the present invention, as the iron oxide-containing material, a specific example is iron ore. The iron oxide-containing material located in the central portion of each of the compacts preferably has a mean particle diameter of 4 to 23 μm.

Another process for manufacturing reduced iron agglomerates according to the present invention that solves the foregoing problems includes charging compacts that contain an iron oxide-containing material, a carbonaceous reducing agent, and a melting-point-adjusting agent onto a hearth of a moving-bed heating furnace, heating the compacts to reduce iron oxide in the compacts, further heating the compacts to at least partially melt the compacts, and coalescing an iron component, in which each of the compacts that contains the iron oxide-containing material having a mean particle diameter of 4 to 23 μm and containing particles with a particle diameter of 10 μm or less in a proportion of 18% by mass or more is used.

Also in this process, as the iron oxide-containing material, a specific example is iron ore. The iron oxide-containing material located in the central portion of each of the compacts preferably has a mean particle diameter of 4 to 23 μm.

Advantageous Effects of Invention

According to the present invention, compacts composed of a raw-material mixture that contains at least an iron oxide-containing material and a carbonaceous reducing agent are charged onto a hearth of a moving-bed heating furnace, and heated to subject iron oxide in the compacts to reduction-melting, thereby providing reduced iron agglomerates. The mean particle diameter and the particle size distribution of the iron oxide-containing material are appropriately controlled, thereby improving the yield of the reduced iron agglomerates having large grain size, reducing the manufacturing time to improve the productivity, and minimizing the contents of impurity elements, such as sulfur, in the reduced iron agglomerates.

DESCRIPTION OF EMBODIMENTS

In the case where reduced iron agglomerates are manufactured, when compacts composed of a mixture that contains an iron oxide-containing material serving as a raw-material component and a carbonaceous reducing agent are formed, each of the iron oxide-containing material and the carbonaceous reducing agent is appropriately pulverized and then is adjusted so as to have uniform size in order to easily granulate them. However, the influence of the size of the raw-material component (mean particle diameter) on the yield and productivity of the reduced iron agglomerates has not been considered. It has been believed that excessive pulverization of the raw-material component leads to the dispersion of the raw-material component, thereby preventing the coalescence of reduced iron to decrease the productivity.

To achieve the foregoing object, the inventors have conducted studies from a variety of perspectives. In particular, the inventors have conducted studies on the influence of the particle diameter and the particle size distribution of the raw-material component on the productivity and have found that appropriate adjustment of the mean particle diameter and the particle size distribution of an iron oxide-containing material successfully achieves the foregoing object. The findings have led to the completion of the present invention.

In the present invention, the iron oxide-containing material in the agglomerates needs to have a mean particle diameter of 23 μm or less and contain particles having a particle diameter of 10 μm or less in a proportion of 18% by mass or more. The term "mean particle diameter" used here indicates a particle diameter (hereinafter, also referred to as "D50") corresponding to 50% by mass (an accumulated value of 50% by mass) when the number of particles is counted from the smallest particle. The reason for the improvement in the yield of the reduced iron agglomerates and the productivity by the use of the fine raw-material component is speculated as follows.

The foregoing compacts are subjected to reduction or reduction-melting at 1200° C. to 1500° C. In the early stage of the reduction reaction, the direct contact between the iron oxide-containing material and the carbonaceous reducing agent permits the reaction to proceed. The pulverization of the iron oxide-containing material into fine particles increases the opportunity for the contact between the iron oxide-containing material and the carbonaceous reducing agent, thus decreasing the reduction time. When the carbonaceous reducing agent begins to gasify, the reduction reaction proceeds from a surface of the iron oxide-containing material. Thus, the pulverization of the iron oxide-containing material into fine particles increases the surface area and decreases the reduction time and the manufacturing time of the reduced iron agglomerates (hereinafter, the reduced iron agglomerates produced by reduction-melting is also referred to particularly as "granular reduced iron").

As the raw-material component used in the present invention, a melting-point-adjusting agent, for example, limestone, fluorite, or dolomite ore, may be contained. In this case, the pulverization of the iron oxide-containing material into fine particles shortens the distance between a gangue component in the iron oxide-containing material and a surface of the melting-point-adjusting agent (increases the probability that the gangue component in the iron oxide-containing material is present close to the surface of the melting-point-adjusting agent) and increases the frequency of the contact between the gangue component and the melting-point-adjusting agent, thereby facilitating the formation of a molten product. This promotes the separation of the gangue from the iron oxide-containing material and the coalescence of the reduced iron oxide component. That is, a phenomenon completely opposite to knowledge recognized in the past may occur.

A sulfur component is mainly contained in the carbonaceous reducing agent. After the gasification of the carbonaceous reducing agent, the sulfur component is left in pellets. The sulfur component is incorporated into the granular reduced iron and a molten gangue component during melting. In the present invention, the molten gangue component is easily formed. Thus, the sulfur component is more likely to be smoothly and rapidly incorporated into the molten component and is less likely to be incorporated into the granular reduced iron, thus seemingly reducing the sulfur concentration in the granular reduced iron.

To efficiently provide the effect, the iron oxide-containing material needs to have a mean particle diameter (D50) of 23 μm or less and contain particles having a particle diameter of 10 μm or less in a proportion of 18% by mass or more. The mean particle diameter is preferably 17 μm or less. If the mean particle diameter (D50) is less than 4 μm, which is excessively small, it is difficult to form the compacts.

As the iron oxide-containing material used in the present invention, iron ore, iron sand, nonferrous smelting residues, or the like may be used. As the carbonaceous reducing agent, a carbon-containing material may be used. For example, coal or coke may be used.

As additional components, a binder, a MgO supply material, a CaO supply material, and so forth may be incorporated into the foregoing compacts. Examples of the binder that may be used include polysaccharides (for example, starch, such as flour). Examples of the MgO supply material that may be used include MgO powders, Mg-containing materials extracted from natural ore and seawater, and magnesium carbonate ($MgCO_3$). Examples of the CaO supply material that may be used include quick lime (CaO), slaked lime ($Ca(OH)_2$), and limestone (main component: $CaCO_3$). In addition, dolomite, which is a double salt of calcium carbonate and magnesium carbonate, may be used.

The shape of the compacts is not particularly limited. Examples thereof include pellets and briquettes. The size of the compacts is not particularly limited. The diameter (maximum diameter) is preferably 50 mm or less. If the diameter of the compacts is excessively large, the agglomeration efficiency is reduced. Moreover, the heat transfer to lower portions of the pellets is reduced, thereby reducing the productivity. The lower limit of the size is about 5 mm.

Not all of the iron oxide-containing material particles in the compacts are required to be pulverized. Ten percent by mass or more of the entire iron oxide-containing material may satisfy the foregoing requirement for the mean particle diameter. An example of a structure that satisfies the requirement is a structure in which the pulverized iron oxide-containing material is present only in at least the central portion of each of the compacts. When the compacts are heated from the outside, a rise in the temperature of the central portion of each compact is delayed, compared with the peripheral portion. Thus, the reaction is also delayed. To relax the phenomenon, it is effective to arrange the pulverized iron oxide-containing material in the central portion. The term "central portion" indicates that, for example, if the compacts have a spherical shape (dry pellet described below), the central portion refers to a portion extending from the center of a sphere to a position that satisfies the foregoing mean particle diameter of the fine particles (a portion outside the portion is defined as a "peripheral portion").

In the case where the pulverized iron oxide-containing material is present in at least the central portion of each of the compacts, a basic structure is as follows: the pulverized iron oxide-containing material specified in the present invention is present only in the central portion, and the raw-material component having a normal mean particle diameter (not pulverized) is present in the peripheral portion. Furthermore, an embodiment of the present invention includes a structure in which all the raw-material component used is the iron oxide-containing material that satisfies the mean particle diameter and the particle size distribution specified in the present invention.

This application claims the benefit of priority of Japanese Patent Application No. 2012-042395 filed Feb. 28, 2012. Japanese Patent Application No. 2012-042395 filed Feb. 28, 2012 is hereby incorporated by reference herein in its entirety.

EXAMPLES

The present invention will now be further described in detail with reference to examples, but it should be understood that the examples are not intended to limit the present invention. Any modification in the range of the purpose described above or below is within the technical scope of the present invention.

Example 1

Compacts composed of a raw-material mixture containing an iron oxide-containing material, a carbonaceous reducing agent, and a binder were produced. The compacts were charged into a heating furnace and heated to subject iron oxide in the compacts to reduction-melting, thereby producing reduced iron agglomerates (granular reduced iron).

In this case, iron ore A having a component composition (composition of main components) described in Table 1 was used as the oxide-containing material. Coal having a component composition described in Table 2 was used as the carbonaceous reducing agent. The compacts were produced with the raw-material components (the iron oxide-containing material and the carbonaceous reducing agent) having different mean particle diameters and different particle size distributions. Specifically, flour serving as the binder was blended with mixtures of iron ore and coal having different mean particle diameters (D50) in a blending ratio described in Table 3. Cylindrical compacts each having a diameter of 20 mm and a height of 10 mm (after the formation, drying was performed at 105° C. for a whole day and night) were produced.

TABLE 1

| Type of iron | Component composition of iron ore (% by mass) | | | | | | |
|---|---|---|---|---|---|---|---|
| ore | T. Fe | FeO | $SiO_2$ | CaO | $Al_2O_3$ | MgO | S |
| A | 66.62 | 0.12 | 2.24 | 0.07 | 0.96 | 0.03 | 0.008 |
| B | 67.61 | 29.14 | 4.9 | 0.45 | 0.23 | 0.49 | 0.003 |

TABLE 2

| Component composition of coal (% by mass) | | | |
|---|---|---|---|
| Fixed carbon | Volatile component | Ash | Total |
| 84.36 | 7.58 | 8.06 | 100 |

TABLE 3

| Blending ratio (% by mass) | | | |
|---|---|---|---|
| Iron ore | Coal | Binder | Total |
| 79.24 | 19.86 | 0.9 | 100 |

The compacts were heated at 1300° C. in a nitrogen atmosphere, and the reduction rate (reaction time) was studied. The reaction time was evaluated by the time required for the rate of reduction of the iron oxide component in the iron ore to reach 90%. Table 4 describes the results together with the mean particle diameters and the particle size distributions of the raw-material components (iron ore and coal) used.

TABLE 4

| Experiment No. | Mean particle diameter of iron ore (μm) | Content of particles with particle diameters of 10 μm or less in iron ore A (% by mass) | Mean particle diameter of coal (μm) | Reaction time (min) |
|---|---|---|---|---|
| 1 | 37 | 6 | 48 | 9.3 |
| 2 | 17 | 32 | 48 | 8.8 |
| 3 | 3.9 | 99 | 48 | 7.7 |
| 4 | 37 | 6 | 14 | 9.1 |
| 5 | 37 | 6 | 2.4 | 9.0 |
| 6 | 17 | 32 | 14 | 8.4 |

The results demonstrate that a smaller mean particle diameter (D50) of the iron ore results in a significant reduction in reaction time. Although an attempt was made to form a compact from iron ore having a mean particle diameter (D50) less than 4 μm, it was found that the formation was impossible.

Example 2

Compacts composed of a raw-material mixture containing an iron oxide-containing material, a carbonaceous reducing agent, melting-point-adjusting agents (limestone, dolomite, and fluorite), and a binder were produced. The compacts were charged into a heating furnace and heated to subject iron oxide in the compacts to reduction-melting, thereby producing reduced iron agglomerates.

In this case, iron ores having component compositions described in Table 1 were used as the oxide-containing material. Coal having a component composition described in Table 5 was used as the carbonaceous reducing agent. As the melting-point-adjusting agents, limestone having a component composition (composition of main components) described in Table 6, dolomite having a component composition (composition of main components) described in Table 7, and fluorite having a component composition (composition of main components) described in Table 8 were used. The compacts were produced with iron ores having different mean particle diameters and different particle size distributions (content of particles with a predetermined particle diameter). Specifically, flour serving as the binder was blended with mixtures iron ores having different mean particle diameters and different particle size distributions in a blending ratio described in Table 9. An appropriate amount of water was added to each of the resulting mixtures. The mixtures were agglomerated with a tire-type pelletizer into green pellets having a diameter of 19 mm. The resulting green pellets were charged into a dryer and heated at 180° C. for 1 hour to completely remove adhesion water, thereby providing pellet-shaped agglomerates (spherical dry pellets).

TABLE 5

| Component composition of coal (% by mass) | | | |
|---|---|---|---|
| Fixed carbon | Volatile component | Ash | Total |
| 79.5 | 15.97 | 4.53 | 100 |

TABLE 6

| Component composition of limestone (% by mass) | | | | |
|---|---|---|---|---|
| $SiO_2$ | CaO | $Al_2O_3$ | MgO | S |
| 0.14 | 56.87 | <0.01 | 0.14 | <0.001 |

TABLE 7

| Component composition of dolomite (% by mass) | | | | |
|---|---|---|---|---|
| $SiO_2$ | CaO | $Al_2O_3$ | MgO | S |
| 2.0 | 35.71 | 0.27 | 16.85 | <0.001 |

TABLE 8

| Component composition of fluorite (% by mass) | | | | |
|---|---|---|---|---|
| $SiO_2$ | T. Ca | $Al_2O_3$ | MgO | F |
| 3.05 | 50.39 | 0.28 | <0.01 | 47.54 |

TABLE 9

| Pattern of blending ratio | Blending ratio (% by mass) | | | | | | |
|---|---|---|---|---|---|---|---|
| | Iron ore | Coal | Lime-stone | Dolomite | Fluorite | Binder | Total |
| a | 75.04 | 18.0 | 1.95 | 3.31 | 0.8 | 0.9 | 100 |
| b | 71.32 | 16.83 | 7.27 | 2.88 | 0.8 | 0.9 | 100 |

The dry pellets were charged into a heating furnace in which a carbon material (anthracite having a maximum particle diameter of 2 mm or less) was placed. The dry pellets were heated at 1450° C. in a nitrogen atmosphere, and the time (reaction time) required for reduction-melting was studied.

Table 10 describes the results together with the mean particle diameters of the raw-material components used (iron ores, coal, limestone, dolomite, and fluorite) and the contents of particles with particle diameters of 10 μm or less in the iron ores (contents of particles with particle diameters of 10 μm or less). Table 10 also describes the general properties of the dry pellets (for example, the apparent density and the analytical value of the dry pellets) (mean value of 10 pellets for each experiment). Among the items described in Table 10, measurement methods and criteria for main items are described below.

[Sulfur Partition]

The ratio of the amount of sulfur [S] in the reduced iron agglomerates to the amount of sulfur (S) in the component composition of slag (by-product slag formed when granular reduced iron is formed) ([S]/(S), sulfur partition) was calculated. The sulfur partition serves as an index of the sulfur content of granular reduced iron.

[Productivity (Productivity Index)]

The productivity when the dry pellets were heated to subject the metal oxide to reduction-melting for the production of reduced iron agglomerates was evaluated by the amount (ton) of reduced iron agglomerates produced per unit time (hour) per hearth area ($m^2$) as represented by the following expression (1):

$$\text{Productivity}(\text{ton}/m^2/\text{hour}) = \text{productivity of granular reduced iron (ton/hour)}/\text{hearth area}(m^2) \quad (1)$$

In the expression (1), the productivity of the granular reduced iron (ton/hour) is represented by the following expression (2):

$$\text{Productivity of granular reduced iron(granular reduced iron ton/hour)} = \text{amount of compact(dry pellet)charged(compact ton/hour)} \times \text{mass of granular reduced iron produced per ton of compact(granular reduced iron ton/compact ton)} \times \text{product recovery ratio} \quad (2)$$

In the expression (2), the product recovery ratio is calculated from the ratio of the mass of the granular reduced iron having a diameter of 3.35 mm or more with respect to the total amount of the resulting granular reduced iron [(granular iron having a diameter of 3.35 mm or more (% by mass)/total weight of granular reduced iron (%))×100(%)] (expressed as "yield of granular iron with particle diameter of 3.35 mm or more (%)" in Table 10). In Table 10, in order to quantitatively evaluate the effect of the present invention, the compacts (dry pellets) in Experiment No. 7 are defined as reference compacts, the productivity when the reference compacts are used is defined as 1.00, and the productivity when these compacts are used is expressed as a relative value (productivity index).

TABLE 10

| | Experiment No. | | | | | |
|---|---|---|---|---|---|---|
| | 7 | 8 | 9 | 10 | 11 | 12 |
| Type of iron ore | A | A | A | A | A | B |
| Mean particle diameter (D50) of raw material | | | | | | |
| Iron ore (μm) | 37 | 17 | 17 | 4 | 37 | 23 |
| Coal (μm) | 21 | 11 | 21 | 21 | 11 | 11 |
| Limestone (μm) | 11 | 4 | 11 | 11 | 11 | 11 |
| Dolomite (μm) | 56 | 3.0 | 56 | 56 | 56 | 56 |
| Fluorite (μm) | 25 | 5 | 25 | 25 | 25 | 25 |
| Content of particle with particle diameter of 10 μm or less in iron ore (% by mass) | 6 | 32 | 32 | 99 | 6 | 18 |
| Raw-material blend | a | a | a | a | a | b |
| Dry pellet | | | | | | |
| Apparent density (g/cm$^3$) | 2.200 | 2.273 | 2.272 | 2.257 | 2.209 | 2.281 |
| Reaction time (min) | 10.42 | 9.44 | 10.40 | 9.16 | 10.64 | 9.57 |
| Analytical value of dry pellet | | | | | | |
| Total iron (%) | 50.31 | 50.29 | 50.29 | 50.29 | 50.41 | 48.35 |
| Granular reduced iron | 82.47 | 99.51 | 100.66 | 102.44 | 82.08 | 103.3 |
| Yield of granular iron with particle diameter of 3.35 mm or more (%) | | | | | | |
| Analytical value of granular reduced iron | | | | | | |
| S (%) | 0.066 | 0.051 | 0.050 | 0.041 | 0.067 | 0.022 |
| Analytical value of slag | | | | | | |
| S (%) | 1.04 | 1.01 | 1.02 | 0.99 | 1.03 | 0.84 |
| Sulfur partition (—) | 15.8 | 19.8 | 20.4 | 24.0 | 15.4 | 38.18 |
| Productivity index (—) | 1.00 | 1.38 | 1.26 | 1.45 | 0.98 | 1.36 |

The results demonstrate that in the case where the iron ore has a mean particle diameter (D50) of 23 μm or less and where it contains particles having a particle diameter of 10 μm or less in a proportion of 18% by mass or more, the yield of the granular reduced iron is improved, thus significantly improving the productivity. The results also demonstrate that the amount of sulfur in the granular reduced iron is reduced. Also in Example 2, although an attempt was made to form a compact from iron ore having a mean particle diameter (D50) less than 4 μm, it was found that the formation was impossible.

Example 3

Dual-structured dry pellets were produced with mixtures each containing the iron oxide-containing material having the same component composition as used in Example 2 (type of iron ore: A), a carbonaceous reducing agent, a melting-point-adjusting agents (limestone, dolomite, and fluorite), and a binder (regarding the blending ratio, the same blending pattern as that described in a of Table 9 was used). Specifically, flour serving as a binder was mixed with a mixture containing iron ore having a mean particle diameter described in "Central portion" of Table 11. An appropriate amount of water was added to the resulting mixture. The mixture was agglomerated into spherical pellets having a diameter of 9.5 mm with a tire-type pelletizer. These pellets were used as cores. A mixture containing the raw-material component having a different mean particle diameter was formed concentrically around each of the cores (peripheral portions) into green pellets having a diameter of 19.0 mm (the content of the mixture in the central portion was about 12% by mass with respect to the entire pellet). The resulting green pellets were charged into a dryer and heated at 180° C. for 1 hour to completely remove adhesion water, thereby providing pellet-shaped agglomerates (dual-structured pellets).

The dual-structured pellets were charged into a heating furnace in which a carbon material (anthracite having a maximum particle diameter of 2 mm or less) was placed. The dual-structured pellets were heated at 1450° C. in a nitrogen atmosphere, and the reduction rate (reaction time) was evaluated in the same way as in Example 2. Table 11 describes the results together with the mean particle diameters (D50) of the raw-material components used (iron ore, coal, limestone, dolomite, and fluorite). Table 11 also describes the items evaluated in Example 2 (by the same evaluation methods as in Example 2).

TABLE 11

| Experiment No. | 13 | |
|---|---|---|
| Position | Central portion | Peripheral portion |
| Type of iron ore | A | A |
| Mean particle diameter (D50) of raw material | | |
| Iron ore (μm) | 17 | 37 |
| Coal (μm) | 21 | 21 |
| Limestone (μm) | 11 | 11 |
| Dolomite (μm) | 56 | 56 |
| Fluorite (μm) | 25 | 25 |
| Raw-material blend | a | a |
| Dry pellet | | |
| Apparent density (g/cm$^3$) | 2.265 | |
| Reaction time (min) | 11.4 | |
| Analytical value of dry pellet | | |
| Total iron (%) | 50.61 | |
| Granular reduced iron | | |
| Yield of granular iron with particle diameter of 3.35 mm or more (%) | 89.45 | |
| Analytical value of granular reduced iron | | |
| S (%) | 0.06 | |
| Analytical value of slag | | |
| S (%) | 1.06 | |
| Sulfur partition (—) | 17.7 | |
| Productivity index (—) | 1.03 | |

The results demonstrate that even when only the central portion is particularly formed of the fine particles without using the fine particles for the entire pellet, the effect of improving the yield of the granular reduced iron is provided, and the sulfur partition is also improved. As described above, the results demonstrate that in the case where only the central portion is particularly formed of the fine particles, even in a state in which a smaller amount of the fine particles of the raw-material component is used, the effect of the present invention is provided.

INDUSTRIAL APPLICABILITY

The present invention provides a process for manufacturing reduced iron agglomerates, in which the process includes charging compacts that contain an iron oxide-containing material and a carbonaceous reducing agent onto a hearth of a moving-bed heating furnace and heating the compacts to reduce iron oxide in the compacts. The use of the compacts containing the iron oxide-containing material which has a mean particle diameter of 4 to 23 μm and which contains particles with a particle diameter of 10 μm or less in a proportion of 18% by mass or more improves the yield of the reduced iron agglomerates having large grain size, reduces the manufacturing time to improve the productivity, and minimizes the contents of impurity elements, such as sulfur, in the reduced iron agglomerates.

The invention claimed is:

1. A method for manufacturing reduced iron agglomerates, the method comprising:

charging a compact comprising an iron oxide-containing material, a carbonaceous reducing agent, and a melting-point-adjusting agent onto a hearth of a moving-bed heating furnace, heating the compact to reduce iron oxide in the compact; further heating the compact to at least partially melt the compact; and coalescing an iron component, thereby producing the reduced iron agglomerates, wherein the iron oxide-containing material in the compact consists of iron ore, the iron oxide-containing material has a mean particle diameter of 4 to 23 pm; and a proportion of particles with a particle diameter of 10 pm or less in the iron oxide-containing material is 18% by mass or more.

2. The method according to claim 1, wherein the iron oxide-containing material located in a central portion of the compact has a mean particle diameter of from 4 to 23 μm.

3. The method according to claim 1, wherein the compact is in the form of a pellet or briquette.

4. The method according to claim 1, wherein the compact further comprises a binder, a MgO supply material, a sulfur component, dolomite, and/or a CaO supply material.

5. The method according to claim 1, wherein the heating temperature is from 1200 to 1500° C.

6. The method according to claim 1, wherein the heating was done in a nitrogen atmosphere.

7. The method according to claim 1, wherein the melting-point-adjusting agent is limestone, fluorite, dolomite or a mixture there.

8. The method according to claim 1, further comprising:

prior to said charging, pulverizing the iron oxide-containing material.

* * * * *